US007104812B1

(12) United States Patent
Bogiel et al.

(10) Patent No.: US 7,104,812 B1
(45) Date of Patent: Sep. 12, 2006

(54) LAMINATED ELECTRICAL TERMINAL

(75) Inventors: Steven B. Bogiel, Lisle, IL (US); Thomas J. Carlson, Maumelle, AR (US); William P. Hendrickson, Yorkville, IL (US); Daniel B. McGowan, Naperville, IL (US); Steven D. Miller, Conway, AR (US); Arvind Patel, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 11/064,792

(22) Filed: Feb. 24, 2005

(51) Int. Cl.
*H01R 4/58* (2006.01)

(52) U.S. Cl. ..... 439/79

(58) Field of Classification Search ..... 439/59, 439/79, 997, 947, 884
See application file for complete search history.

(56) References Cited

U.S. PATENT DOCUMENTS 4,820,170 A * 4/1989 Redmond et al. ..... 439/66
4,983,132 A 1/1991 Weidler
5,052,853 A * 10/1991 Trowbridge ..... 404/92
5,052,953 A * 10/1991 Weber ..... 439/857
5,823,834 A * 10/1998 Straeb et al. ..... 439/884
5,997,347 A * 12/1999 Robinson et al. ..... 439/517
6,238,225 B1 * 5/2001 Middlehurst et al. ..... 439/212
6,319,075 B1 * 11/2001 Clark et al. ..... 439/825
6,402,566 B1 * 6/2002 Middlehurst et al. .... 439/699.1
6,471,523 B1 * 10/2002 Shuey ..... 439/63
6,604,967 B1 * 8/2003 Middlehurst et al. ..... 439/862
6,645,012 B1 11/2003 Ito et al.
6,652,322 B1 11/2003 Ito et al.
6,659,783 B1 12/2003 Copper et al.
6,786,781 B1 * 9/2004 Sai et al. ..... 439/884
6,974,329 B1 * 12/2005 Henneberg ..... 439/59

* cited by examiner

*Primary Examiner*—Tulsidas C. Patel
*Assistant Examiner*—Harshad C Patel
(74) *Attorney, Agent, or Firm*—Stephen Z. Weiss

(57) ABSTRACT

A laminated terminal is provided for an electrical connector and includes a plurality of flat metal layers juxtaposed to form a laminated structure. Each metal layer includes a joining section, a contact section and a terminating section. A plurality of projections on the joining sections of the layers are interengaged within a respective plurality of recesses in adjacent layers to align the layers and provide a strong mechanical and good electrical joint between the layers. Solder tails extend linearly along the bottom edge of each joining section to form a plurality of rows of solder tails, and the terminating portions of the metal layers are bent outwardly to separate the rows of solder tails from each other. The contact section of one metal layer may include a generally planar finger which is coplanar with a planar finger of another of the metal layers.

6 Claims, 7 Drawing Sheets

FIG. 1
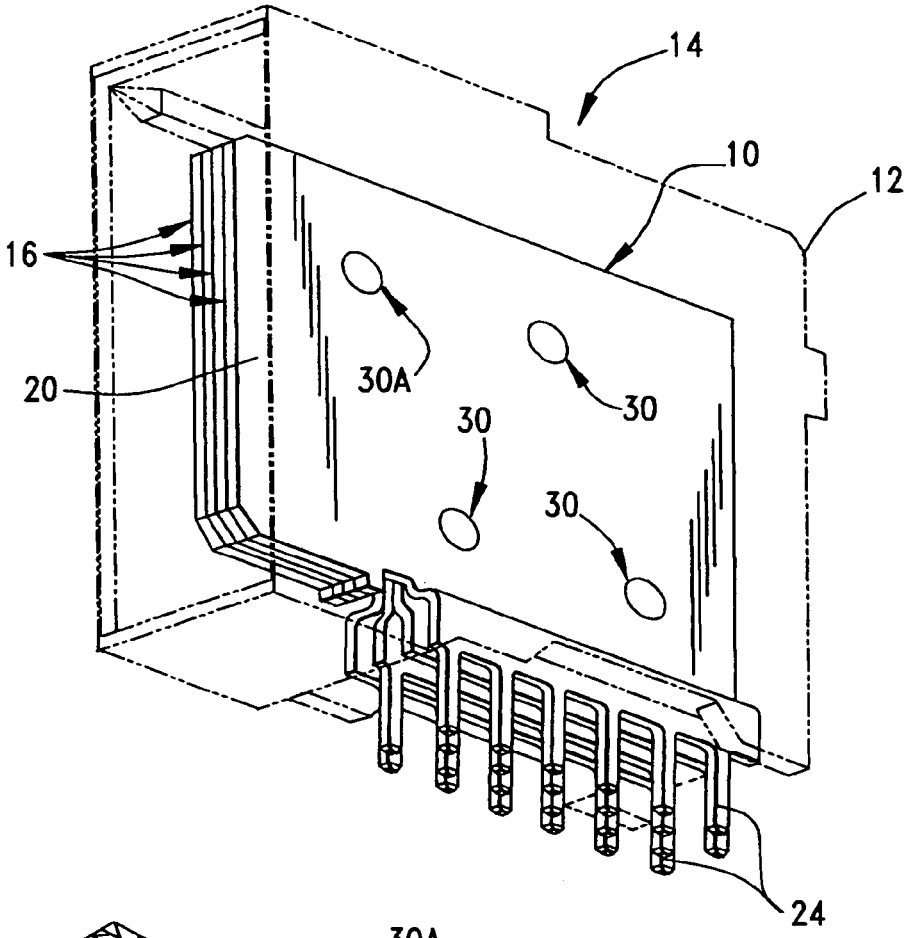
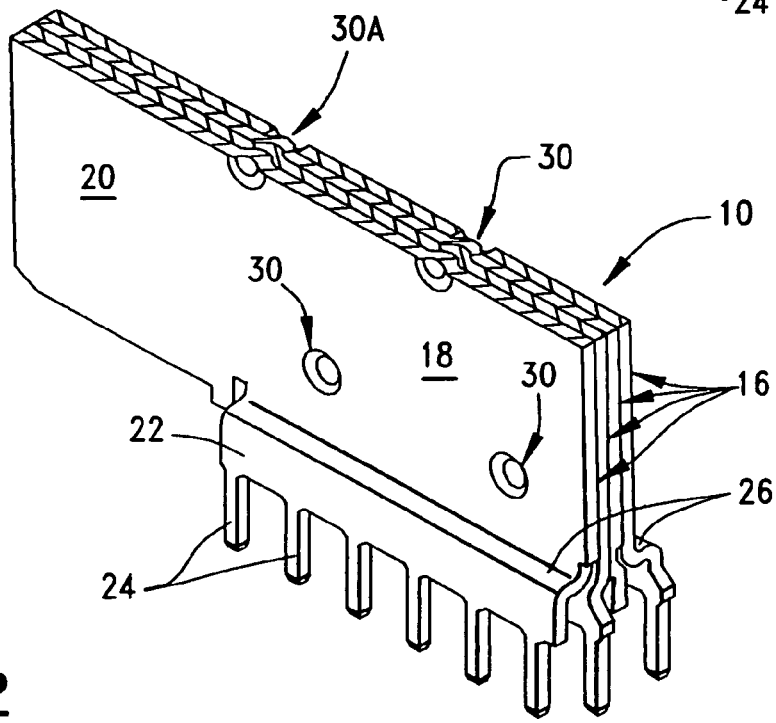
FIG. 2

FIG. 3
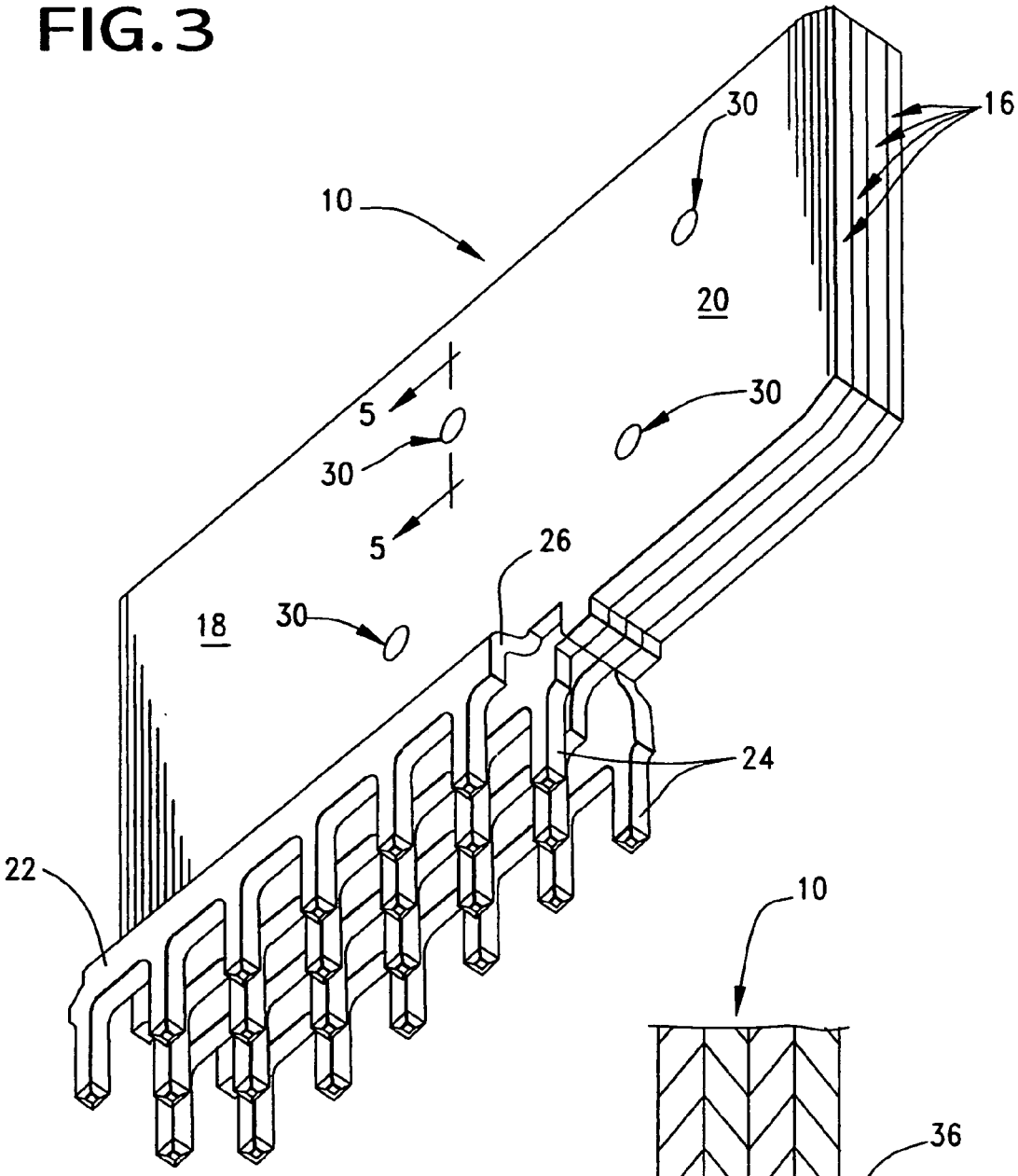
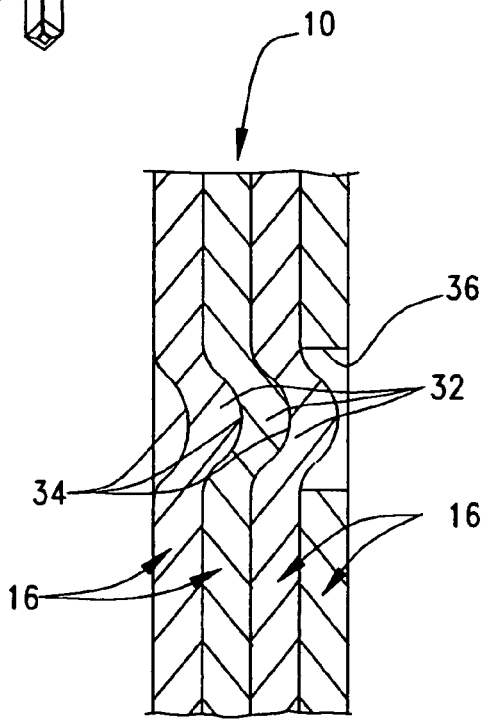
FIG. 5

FIG. 10
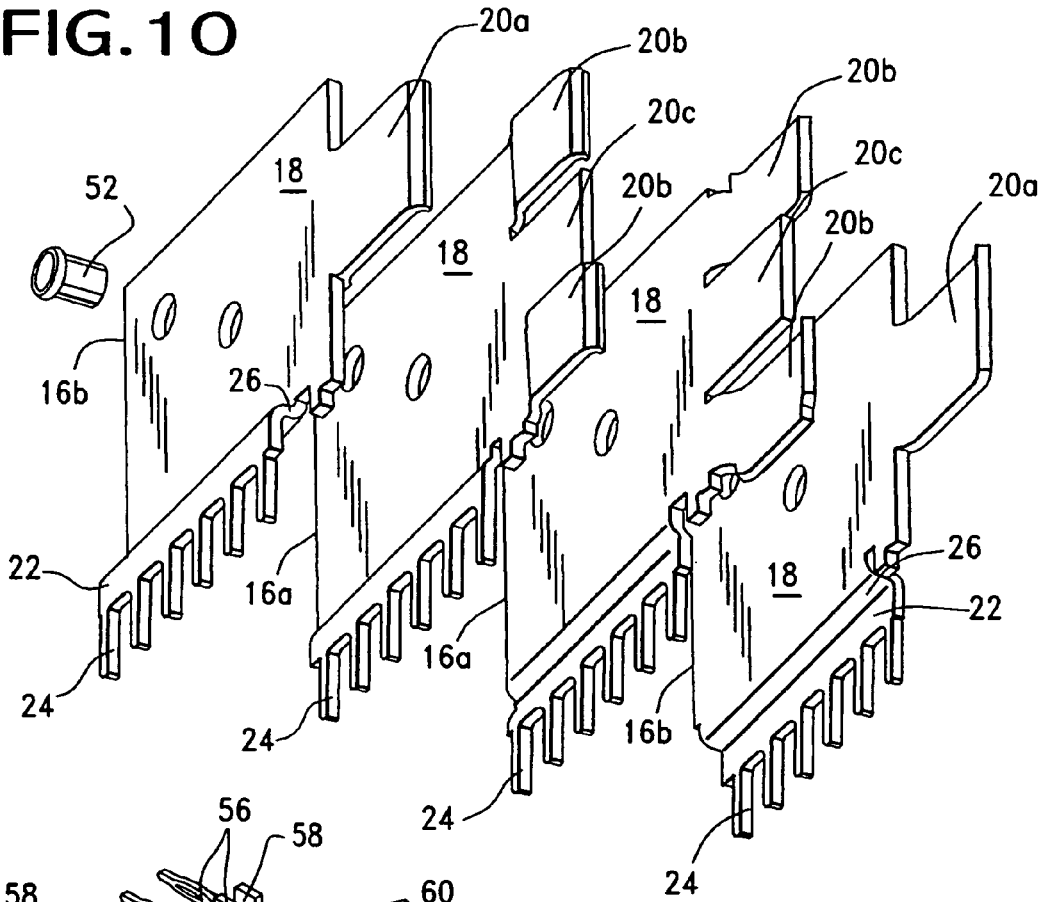
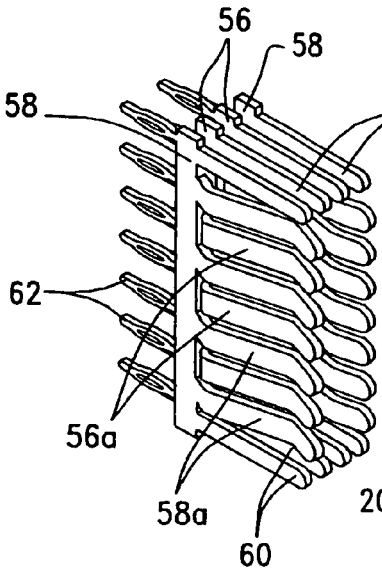
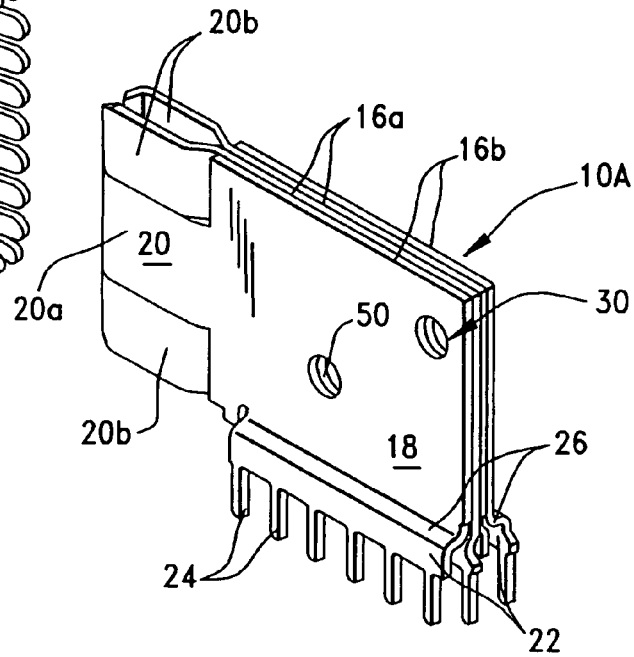
FIG. 11

FIG. 14
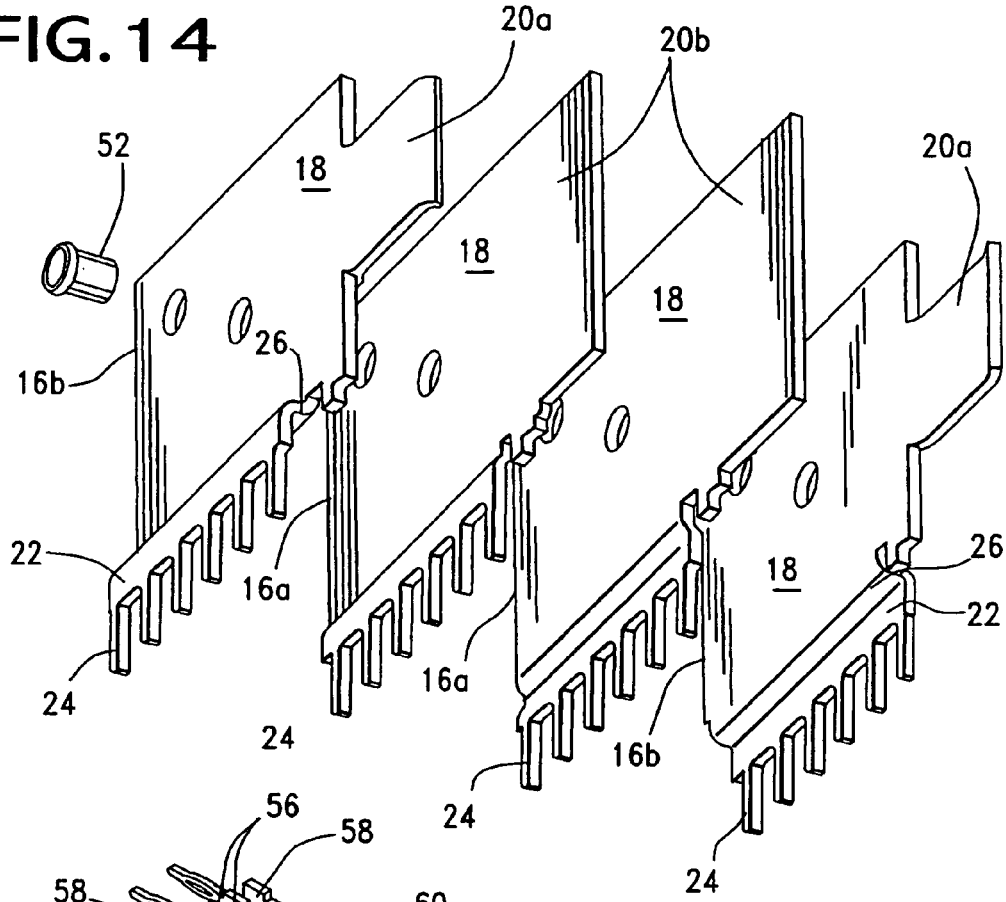
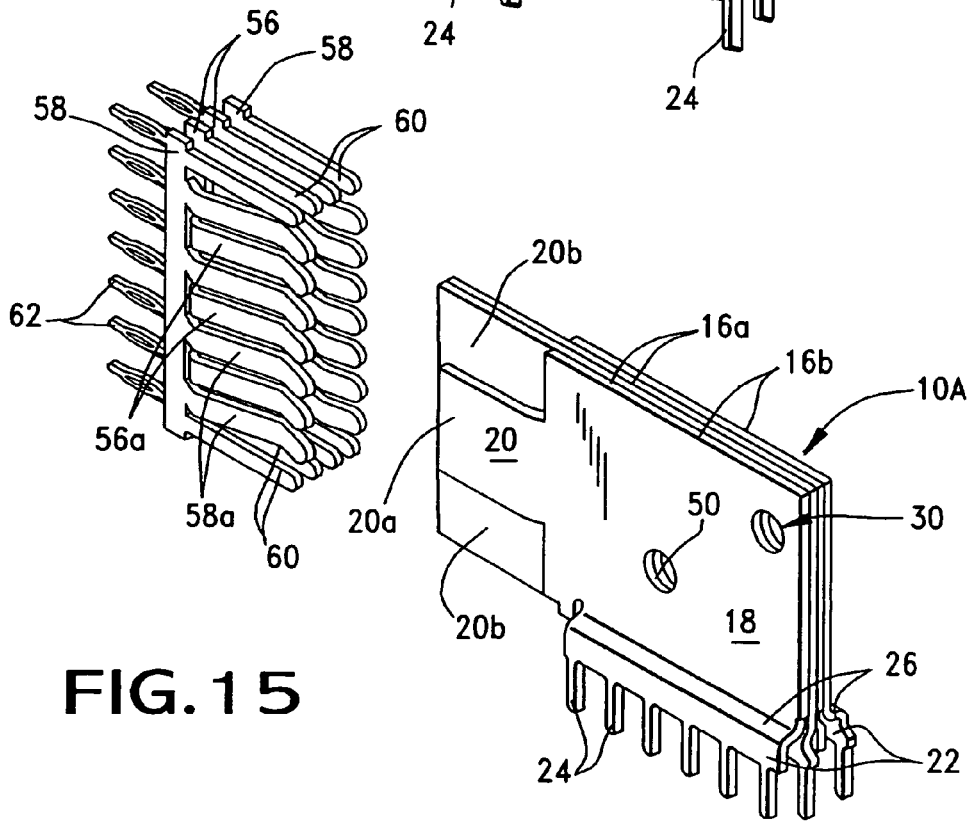
FIG. 15

LAMINATED ELECTRICAL TERMINAL

FIELD OF THE INVENTION

This invention generally relates to the art of electrical connectors and, particularly, to a laminated electrical terminal which includes a plurality of juxtaposed metal layers.

BACKGROUND OF THE INVENTION

Generally, an electrical connector typically includes some form of insulative or dielectric housing which mounts one or more conductive terminals. The housing is configured for mating with a complementary mating connector or other connecting device which, itself, has one or more conductive terminals. A connector assembly typically includes a pair of mating connectors, such as plug and receptacle connectors sometimes called male and female connectors. The terminals typically have terminating ends exposed at a terminating face of the housing for connection to various conductors, such as discrete conductors of a plurality of electrical cables or the circuit traces on a printed circuit board. The terminals have contact ends located at a mating face of the housing for engaging the terminals of the complementary mating connector or other connecting device.

The terminals of some electrical connectors include a plurality of flat metal layers juxtaposed to form a laminated structure. This might be done to increase the current carrying capability of the terminal. Terminals typically are stamped and formed of sheet metal material and folded together to form two adjacent layers at the contact end of the terminal, for instance. Laminations increase the strength of the terminal by increasing the thickness thereof, whereas thick metal layers are difficult and expensive to stamp and form of sheet metal of a relatively thick material.

Unfortunately, the plurality of metal layers of laminated terminals are difficult to align during manufacturing processes wherein the layers typically are welded together. Other problems involve delamination of the layers during fabrication of the terminals, manufacture of the connectors and repeated usage thereof. The welds have a tendency to break over time and repeated usage. The present invention is directed to solving these problems.

In addition, the invention provides for better electrical distribution between the metal layers of the laminated terminal. Still further, the various layers of the terminal are bent apart at their bottom edges to provide spaced multiple rows of solder tails.

SUMMARY OF THE INVENTION

An object, therefore, of the invention is to provide a new and improved laminated terminal for an electrical connector.

Another object of the invention is to provide a new and improved blade terminal for an electrical power connector.

In the exemplary embodiment of the invention, a laminated terminal for an electrical connector includes a plurality of flat metal layers juxtaposed to form a laminated structure which includes a joining section, a contact section and a terminating section. A plurality of projections on the joining sections of the layers are interengaged within a respective plurality of recesses in adjacent layers to align the layers and provide a strong mechanical and good electrical joint between the layers.

According to one aspect of the invention, the projections are punched from the metal material of the layers, whereby a projection in any given layer forms a recess behind the projection for receiving a projection from an adjacent layer. Preferably, the projections are rounded. Still further, it is contemplated that the layers are spot welded together at the projections and recesses.

According to another aspect of the invention, the recesses in an outer layer of the joining section comprise holes to avoid the projections of an adjacent layer from projecting through the outer layer. Preferably, the holes have concave edges curved for engaging the curvature of the rounded projections.

According to a further aspect of the invention, the terminating portions include a plurality of solder tails for connection to appropriate circuit traces on a printed circuit board. The solder tails project downwardly from edges of the laminated layers to form a plurality of rows of solder tails. Preferably, lower portions of the joining sections are separated from each other to space the rows of solder tails from each other.

According to still another aspect of the invention, the contact blade portion of one metal layer may include a generally planar finger which is coplanar with a generally planar finger of another of the metal layers. For instance, a single planar finger of one metal layer can be disposed between and coplanar with a pair of planar fingers of another of the metal layers to form a single planar blade.

In one embodiment of the invention, four metal layers form a pair of inside layers and a pair of outside layers. Each inside layer has a contact blade portion including a generally planar finger which is coplanar with a generally planar finger of a contact blade portion of an adjacent one of the outside layers. Each combination of a contact blade portion from an inside layer and a contact blade portion of its respective outside layer are configured such that one contact blade portion includes a single planar finger disposed between and coplanar with a pair of planar fingers of the contact blade portion of the other layer to form a single planar blade. The single planar blades of the combinations of inside and outside layers are spaced from each other.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the FIGS. and in which:

FIG. 1 is a perspective view of a laminated terminal structure mounted within a connector housing which is shown in phantom to facilitate the illustration of the interior laminated terminal structure, according to one embodiment of the invention;

FIG. 2 is a to perspective view of the laminated terminal structure cut horizontally in section;

FIG. 3 is a bottom perspective view of the laminated structure;

FIG. 5 is an enlarged, fragmented section taken generally along line 5—5 in FIG. 3;

FIG. 10 is an exploded perspective view of the second embodiment;

FIG. 11 is a perspective view of the laminated terminal structure about to be mated with a plurality of mating contacts;

FIG. 14 is an exploded perspective view of a variation of the second embodiment; and FIG. 15 is a perspective view of the laminated terminal structure about to be mated with a plurality of mating contacts.

DETAILED DESCRIPTION OF THE PREFERRED EMBODIMENTS

Figure 4:
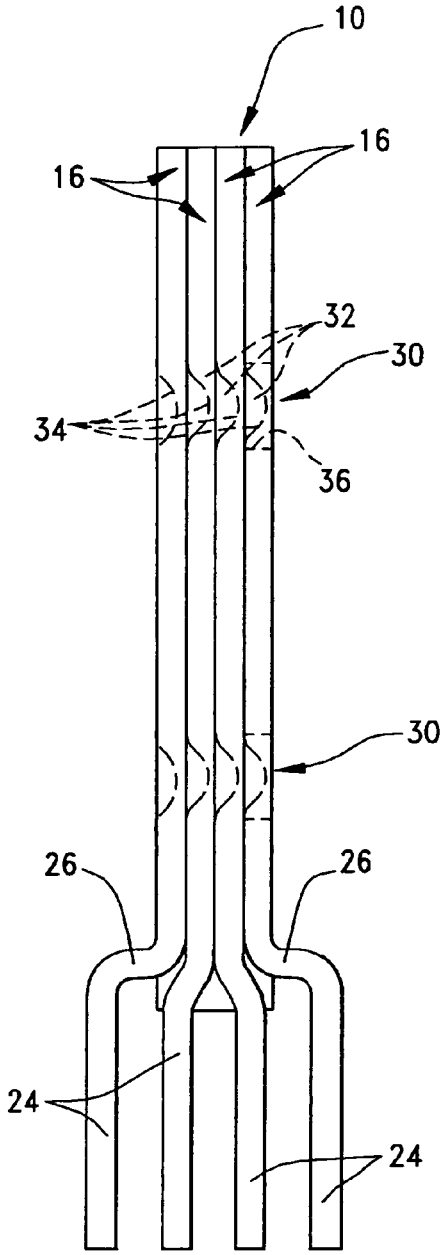
FIG. 4 is an end elevational view of the laminated structure, looking toward the left-hand end of FIG. 3.

Referring to the drawings in greater detail, and first to FIG. 1, a first embodiment of the invention is incorporated in a laminated terminal structure, generally designated 10, which may be mounted in a dielectric housing 12 of an electrical connector, generally designated 14. In the exemplary embodiment, laminated terminal structure 10 is a "blade terminal" for an electrical power connector. However, it should be understood that the concepts of the invention are equally applicable for a wide variety of different types and configurations of electrical connectors.

Referring to FIGS. 2 and 3 in conjunction with FIG. 1, laminated terminal structure 10 is formed of a plurality of flat metal layers, generally designated 16, juxtaposed against each other to form the laminated structure. Each layer includes a joining section 18, a contact section 20 and a terminating section 22. Joining section 18 is a flat plate or body, and contact section 20 is in the form of a blade portion projecting from and coplanar with the joining section for mating with an appropriate terminal of a complementary connecting device.

Terminating portion 22 of each metal layer 16 projects downwardly from joining section 18 for connection to appropriate conductor means. In the exemplary embodiment, the terminating portion includes a plurality of solder tails 24 for insertion into appropriate holes in a printed circuit board and for connection, as by soldering, to appropriate circuit traces on the board and/or in the holes. The solder tails extend linearly along the bottom edge of each joining section 18 and, thereby, form a plurality of rows of solder tails. To that end, terminating portions 22 of the metal layers are bent outwardly, as at 26, to separate the rows of solder tails from each other.

Generally, the invention contemplates the provision of interference means, generally designated 30, between the respective metal layers 16 of laminated terminal structure 10. The interference means are spaced at a plurality of locations about the laminated structure as seen clearly in FIGS. 1–3. The interference means align the layers and provide a strong mechanical and good electrical joint between the layers.

More specifically, and referring to FIG. 5 in conjunction with FIGS. 1–4, the interference means at each location is formed by a rounded projection 32 which is punched or stamped from the sheet metal material of the layers, whereby each projection in any given layer forms a rounded recess behind the projection for receiving a projection from an adjacent layer. In other words, when projections 32 of a plurality of layers are aligned, and the layers are juxtaposed against each other, the projections nest within the recesses as shown in FIG. 5.

Although a plurality of interference means 30 are shown spaced about joining sections 18 of metal layers 16, one of the interference means 30A is located forwardly into the contact sections or blade portions of the layers.

FIG. 5 also shows a feature of the invention to prevent any of the projections 32 from projecting outwardly beyond the flat sides of the laminated structure. Specifically, holes 36 are formed in the outer-most layer into which the projection 32 of the immediately adjacent inner layer projects. Therefore, it can be seen that opposite sides of laminated terminal structure 10 remain flat or planar.

Figure 6:
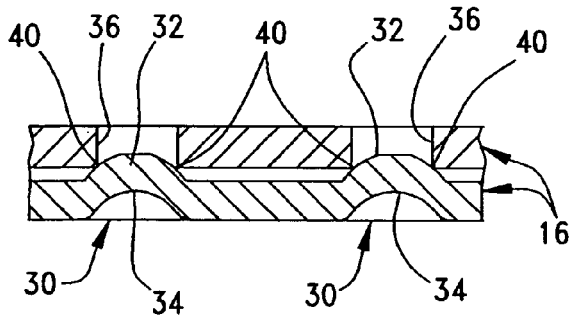
FIG. 6 is a view somewhat similar to that of FIG. 5, but showing a laminated structure of only two layers.

FIG. 6 shows an exaggeration of a pair of projections 32 of an inner metal layer 16 extending into a pair of holes 36 in the outer-most layer, for instance. The invention contemplates that metal layers 16 be spot welded together at the plurality of interference means 30 whereat a plurality of projections 30 are nested. In the configuration of FIG. 6, the spot welds would be concentrated at a plurality of points 40.

Figure 7:
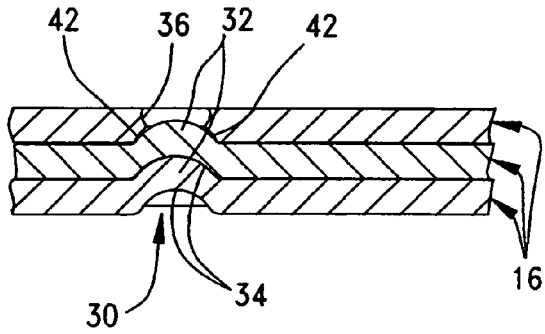
FIG. 7 is a view similar to that of FIG. 6, but of an alternative structure of the first embodiment of the invention.
Figure 8:
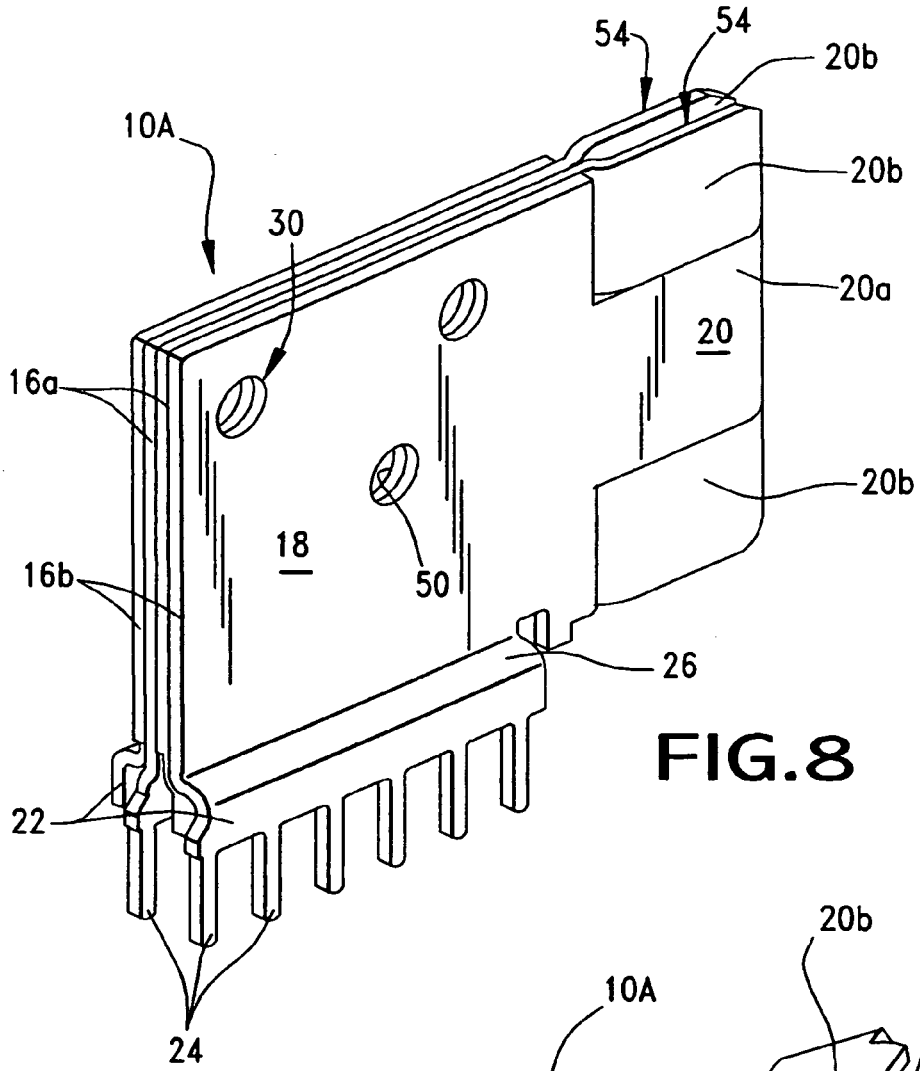
FIG. 8 is a perspective view of a laminated terminal structure according to a second embodiment of the invention.
Figure 9:
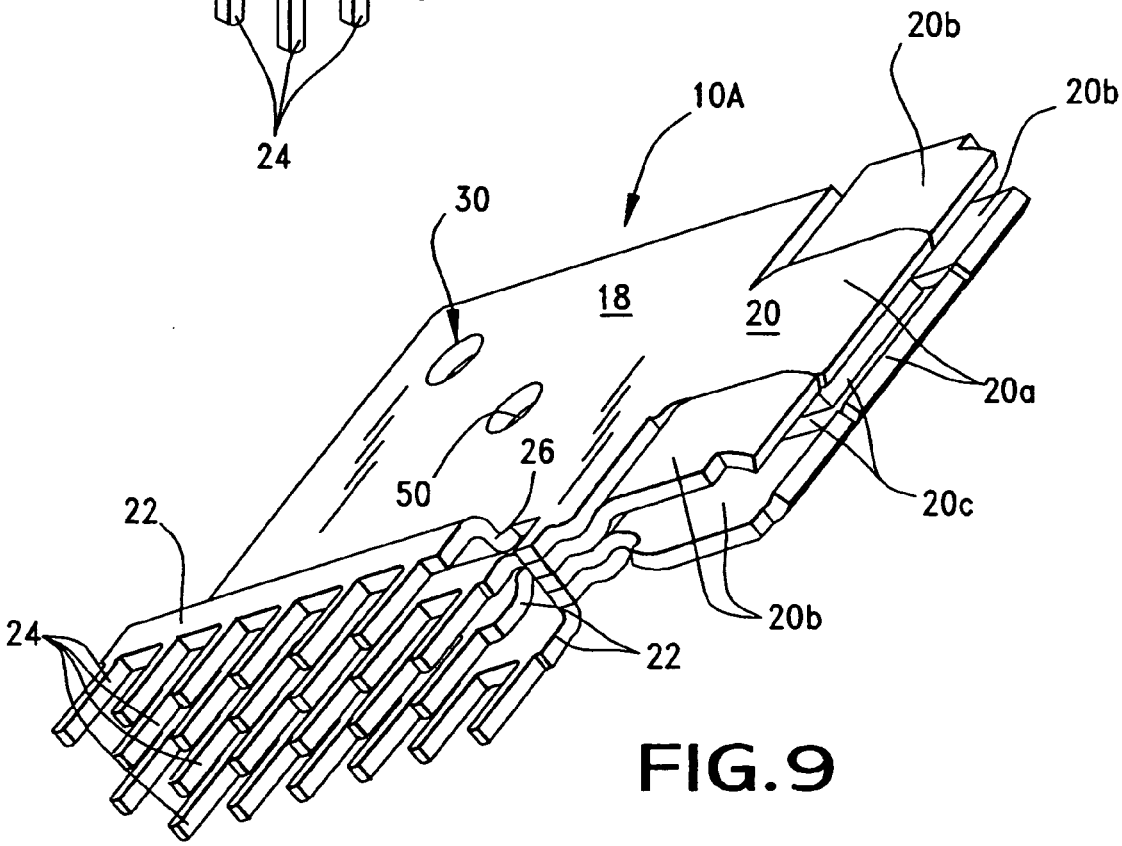
FIG. 9 is a view similar to that of FIG. 3, but of the second embodiment.

However, FIG. 7 shows an improvement wherein the sides or edges of holes 36 are rounded, as at 42, so that a substantial surface area is provided for engaging the convex surface area of projection 32. This increases the strength and stability of the welds at the interference means which includes the outermost metal layer.

FIGS. 8–15 show a second embodiment of the invention incorporated in a laminated terminal structure, generally designated 10A. Like reference numerals will be applied to like components which were described above in relation to the first embodiment, in order to provide a more cohesive description.

To that end, laminated terminal structure 10A is a "blade terminal" for an electrical power connector or other type of electrical connector. The laminated structure is formed by a pair of inside metal layers 16*a* and a pair of outside metal layers 16*b*. Each layer includes a joining section 18, a contact section 20 and a terminating section 22. Joining section 18 is a flat plate or body. The joining sections are joined by at least one interference means, generally designated 30 and described above in relation to the first embodiment. As an alternative to the non-conductive housing by itself keeping all of the metal layers together, a through hole 50 extends through the joining sections for receiving a fastener 52 (FIG. 10) such as a rivet.

As with the first embodiment, terminating portion 22 of each metal layer 16*a* and 16*b* projects downwardly from the respective joining section 18 for connection to appropriate conductor means. As disclosed herein, the terminating portion includes a plurality of solder tails 24 for insertion into appropriate holes in a printed circuit board and for connection, as by soldering, to appropriate circuit traces on the board and/or in the holes. The solder tails extend linearly along the bottom edge of each joining section 18 and, thereby, form four rows of solder tails. As with the first embodiment, terminating portions 22 of the metal layers are bent outwardly, as at 26, to separate the four rows of solder tails from each other. This can be seen clearly in FIG. 9.

The second embodiment of FIGS. 8–15 incorporates a unique configuration of the contact blade portions of metal layers 16*a* and 16*b*. Generally, the contact blade portion of each metal layer includes at least one generally planar finger which is in a plane parallel and immediately adjacent to a generally planar finger of another of the metal layers. This improves the electrical distribution between the layers and accompanying mating contacts.

More particularly, each outside metal layer 16*b* includes a single planar finger 20*a* which is disposed between and coplanar with a pair of planar fingers 20*b* of the immediately adjacent inside metal layer 16*a*. Therefore, the combination of the single planar finger 20*a* of one of the outside layers 16*b* and the two planar fingers 20*b* of the adjacent inside layer 16*a* forms a single planar blade which has been generally designated 54. There being four metal layers 16*a* and 16*b* in laminated structure 10A, it can be seen that two single planar blades 54 are formed by the four metal layers. The planar blades are separated from each other and include at least one planar finger of a combination of a pair of metal layers, namely one inside metal layer 16*a* and its immediately adjacent outside metal layer 16*b*. Each inside metal layer 16*a* includes a center planar finger 20*c* which serves as a back-up for the planar finger 20*a* of the respective outside metal layer 16*b*.

Figure 12:
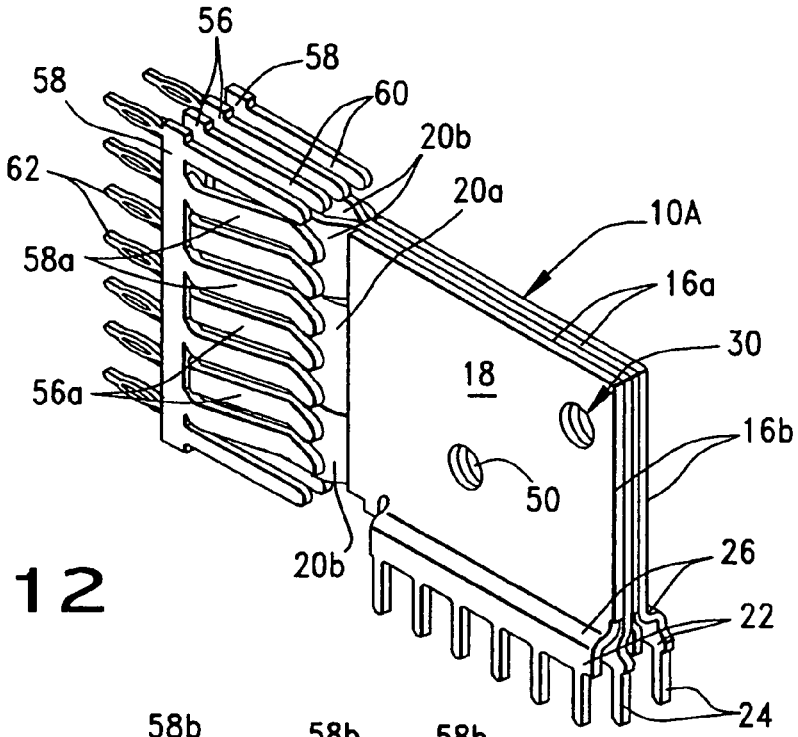
FIG. 12 is a view similar to that of FIG. 11, with the laminated terminal structure mated with the mating contacts.
Figure 13:
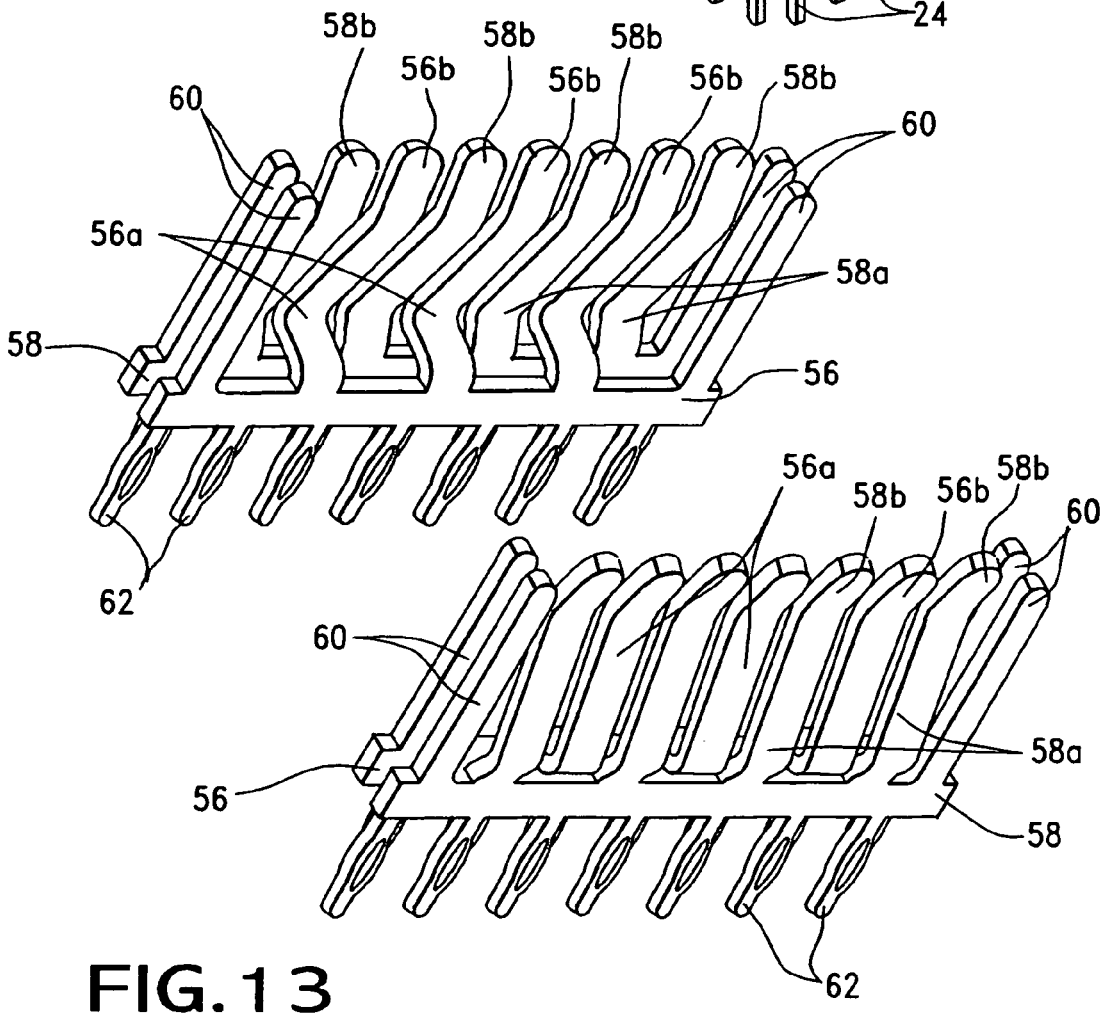
FIG. 13 is a perspective view of the mating contacts.

FIGS. 11–13 show laminated terminal structure 10A of the second embodiment of the invention mateable with four mating contacts which comprise a pair of inside contacts 56 and a pair of outside contacts 58. Each combination of one inside contact 56 and one outside contact 58 engage the planar fingers 20*a* and 20*b* of a single planar blade 54. Each combination of the one inside contact 56 and the one outside contact 58 may or may not be in electrical engagement in the non-conductive housing (not shown).

Specifically, each inside mating contact 56 includes a plurality of spring contact fingers 56*a*, and each outside mating contact 58 includes a plurality of spring contact fingers 58*a*. Contact fingers 56*a* have distal contact ends 56*b*, and contact fingers 58*a* have distal contact ends 58*b*. Contact fingers 56*a* and 58*a* are bent so that their contact ends 56*b* and 58*b*, respectively, are coplanar for engaging the outside of one of the single planar blades 54 of laminated terminal structure 10A.

In addition, each pair of an inside mating contact 56 and an outside mating contact 58 have positioning fingers 60 at opposite ends of spring contact fingers 56*a* and 58*a*. The positioning fingers of each pair of inside and outside mating contacts 56 and 58, respectively, are spaced from each other to sandwich the respective single planar blade 54 therebetween.

FIGS. 11–13 show that mating contacts 56 and 58 have tail portions 62 for insertion into appropriate holes in an appropriate printed circuit board, it should be understood that the above description of the mating contacts are equally applicable for other types of mating terminal configurations.

FIGS. 14–15 show a variation of this second embodiment where a single planar finger 20*a* is in direct contact with a single finger 20*b* in an adjacent joining section. Fingers 20*a* and 20*b* are in different planes. This arrangement separates the one finger 20*b* into two fingers 20*b*, as with the first variation of the second embodiment, so that power can be distributed among the layers. Also the contact ends 56*b*, 58*b* of the three inside contact fingers 56*a*, 58*a* are located in a different plane than the two inside contact fingers at each end so that they cooperate with the different planes of fingers 20*a* and 20*b* respectively.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A blade terminal for an electrical power connector, comprising:

at least a pair of metal layers juxtaposed to form a laminated structure and the metal layers including, generally planar joining sections, terminating portions projecting from the joining sections for connection to appropriate conductor means, and contact blade portions projecting from the joining sections for mating with appropriate terminal means of a complementary connecting device, the contact blade portion of each metal layer including a finger which is immediately adjacent to a finger of another of the metal layers, wherein the contact blade portion of one metal layer includes a single finger between and coplanar with a pair of fingers of another of the metal layers to form a single planar blade.

2. The blade terminal of claim 1, including four of said metal layers forming a pair of inside metal layers and a pair of outside metal layers, the contact blade portion of each inside metal layer including a finger which is coplanar with a finger of the contact blade portion of an adjacent one of the outside metal layers.

3. The blade terminal of claim 2 wherein each combination of the contact blade portions of an inside metal layer and an outside metal layer are configured such that one contact blade portion includes a single finger between and coplanar with a pair of fingers of the other contact blade portion to form a single blade.

4. The blade terminal of claim 3 wherein the single blades of the contact blade portions of the combinations of inside and outside metal layers are spaced from each other.

5. The blade terminal of claim 1 wherein the contact blade portion of one layer has at least one finger in one plane in direct contact with at least one finger of another layer in a second co-planar plane.

6. A laminated terminal for an electrical power connector, comprising:

at least a pair of metal layers juxtaposed to form a laminated structure and the metal layers including, generally planar joining sections, terminating portions projecting from the joining sections for connection to appropriate conductor means, and contact blade portions projecting from the joining sections for mating with appropriate terminal means of a complementary connecting device, the contact blade portion of each metal layer including a finger which is in a plane parallel and immediately adjacent to a finger of another of the metal layers, wherein the contact blade portion of one metal layer includes a single finger between and coplanar with a pair of fingers of another of the metal layers to form a single laminated terminal.

* * * * *